US006758208B2

(12) United States Patent
Giérula et al.

(10) Patent No.: US 6,758,208 B2
(45) Date of Patent: Jul. 6, 2004

(54) FLEXIBLE GAS-FIRED HEAT EXCHANGER SYSTEM

(75) Inventors: Laurent Giérula, Laval (CA); Michel André Lamarche, Lachute (CA)

(73) Assignees: Technologies Echangeur Gaz Air (TEGA) Inc., Laval (CA); Gaz Métropolitain, Montreal (CA); Centre des Technologies du Gaz Naturel, Boucherville (CA)

( * ) Notice: Subject to any disclaimer, the term of this patent is extended or adjusted under 35 U.S.C. 154(b) by 19 days.

(21) Appl. No.: 10/321,636

(22) Filed: Dec. 18, 2002

(65) Prior Publication Data

US 2003/0084896 A1 May 8, 2003

Related U.S. Application Data

(63) Continuation-in-part of application No. 09/760,651, filed on Jan. 17, 2001, now abandoned.

(51) Int. Cl.[7] ..... F24H 3/00

(52) U.S. Cl. ..... 126/116 A; 126/110 R; 126/99 A; 431/20; 431/280; 431/281; 236/1 EA; 236/11

(58) Field of Search ..... 126/110 R, 99 R, 126/116 R, 99 A, 39 N; 431/20, 278, 280, 281, 60; 236/1 G, 1 EA, 10, 11; 138/38; 251/147; 165/109.1, 177; 137/883, 561 R, 147

(56) References Cited

U.S. PATENT DOCUMENTS

| | | | | | |
|---|---|---|---|---|---|
| 2,470,996 | A | * | 5/1949 | McGrath | 236/1 E |
| 3,735,148 | A | * | 5/1973 | Sapir | 361/162 |
| 4,431,131 | A | * | 2/1984 | McInnes | 236/11 |
| 4,614,491 | A | * | 9/1986 | Welden | 431/60 |
| 5,271,376 | A | * | 12/1993 | Lu et al. | 126/110 R |
| 5,441,405 | A | * | 8/1995 | Bedford et al. | 431/286 |
| 5,524,556 | A | * | 6/1996 | Rowlette et al. | 110/162 |
| 5,590,642 | A | * | 1/1997 | Borgeson et al. | 126/116 A |
| 5,649,529 | A | * | 7/1997 | Lu et al. | 126/116 R |
| 5,732,691 | A | * | 3/1998 | Maiello et al. | 126/116 A |
| 5,749,355 | A | * | 5/1998 | Roan et al. | 126/110 R |
| 5,775,318 | A | * | 7/1998 | Haydock et al. | 126/110 R |
| 5,989,020 | A | * | 11/1999 | Glass et al. | 432/161 |
| 6,029,653 | A | * | 2/2000 | Tiszai | 99/403 |
| 6,179,212 | B1 | * | 1/2001 | Banko | 236/1 E |
| 6,223,740 | B1 | * | 5/2001 | Kim et al. | 126/110 R |
| 6,234,164 | B1 | * | 5/2001 | Yasui | 126/110 R |
| 6,237,638 | B1 | * | 5/2001 | Asta et al. | 137/883 |
| 6,250,382 | B1 | * | 6/2001 | Rayburn et al. | 165/248 |

FOREIGN PATENT DOCUMENTS

| | | | |
|---|---|---|---|
| JP | 61295423 | A | * 12/1986 |
| JP | 04369311 | A | * 12/1992 |
| JP | 05118516 | A | * 5/1993 |
| JP | 09014619 | A | * 1/1997 |

* cited by examiner

*Primary Examiner*—James C. Yeung
(74) *Attorney, Agent, or Firm*—Ogilvy Renault; Guy Houle

(57) ABSTRACT

A compact, highly flexible and efficient, multi-positionable, multi-dimensional and multi-stage gas-fired heat exchanger system as described. The system is connectable in a forced air duct regardless of the angular position and size of the duct. The heat exchanger comprises one or more heat transfer tubes which are shaped and dimensioned as dictated by the customized use of the heat exchanger. The tubes are secured to a support panel as well as the gas burner associated with each of the inlet openings of the tubes. A position orientable gas valve is secured to a gas distribution manifold. A turbulator may be associated with at least some of the tubes to cause turbulence in the hot combustion flow in each of the tubes to modify the efficiency in heat transfer along one or more sections of the tubes by directing hot combustion gas along an inner circumferential wall of the tubes. The outlet of the tubes connect to a collector which has an exhaust fan which is position orientable to suit the installation of the heat exchanger in the duct.

27 Claims, 13 Drawing Sheets

FLEXIBLE GAS-FIRED HEAT EXCHANGER SYSTEM

This is a Continuation-In-Part of U.S. patent application Ser. No. 09/760,651 filed Jan. 17, 2001 and now abandoned.

FIELD OF THE INVENTION

The present invention relates to a compact, highly flexible and efficient, multi-positionable, multi-dimensional and multi-stage gas-fired heat exchanger system for use in a forced air duct. The heat exchanger utilizes a cascaded array of serpentine heat transfer tubes. Particularly, the heat exchanger of the present invention utilizes a controller which controls the exhaust fan capacity to ensure a constant supply of gas/air mixture in the tubes which are in operation. The heat exchanger system is also adaptable to existing duct regardless of the size and orientation of the duct.

BACKGROUND OF THE INVENTION

It is very difficult to substitute a gas heater for an electric hot water or oil-fired heater, as this requires a restructure of the existing ductwork. Accordingly, these conversions are extremely costly and not very practical and popular. However, there exists a commercial need to convert to a gas heater which is highly efficient in terms of energy delivered and non-polluting.

There is on the market place a multitude of gas heaters but these are all of substantially standard dimensions and installed in or equipped with air convection ducts. There is no gas-fired heating equipment on the market today that can be used to economically and efficiently convert an electric heating system to gas. The problem is that the heating equipment are of fixed dimensions, cumbersome and require large installation space. The installation of the equipment is also difficult as it must always be installed horizontal and this requires extensive modification to the ventilation ducts. Also, existing gas heaters need to be mounted horizontal as electric equipment does not. Another problem with gas heaters is that the gas supply as well as the exhaust systems are very cumbersome and do not provide much flexibility to the installer.

An example of a gas-fired heater used in a forced air system is illustrated and described in U.S. Pat. No. 5,368,010. It is a fixed system and it is located in a furnace unit which is supported on a floor located at the base of the ductwork. This patent deals primarily with the evacuation of combustion gases at the outlet of the heat exchange tubes. Reference is also made to U.S. Pat. Nos. 5,042,453, 5,094,224 and 4,729,207 as other examples of gas-fired heaters used as a furnace associated with an air convection duct system.

With multi-stage gas-fired heat exchanger systems, a major problem has been the efficiency of the burners and hence the production of NOx only. In an attempt to resolve NOx reduction, U.S. Pat. No. 5,649,529 teaches disposing a metal mesh tube having a diameter substantially less than the internal diameter of the combustion tubes, at the inlet of the tubes. When the burners operate, the burner flames are forced through the meshtubes to reduce the cross-section of the flames to increase their axial velocity through the associated tube to diminish the intimate contact of secondary combustion air with the maximum temperature zones of the flames within the combustor tube. This arrangement has not proven adequate to resolve the problem, is more costly, and requires additional maintenance and repairs.

With a multi-stage system, there is a constant variation of the number of burners that are operated depending on temperature variation in the space being heated. Therefore, most often, not all tubes are used at the same time. This means that some tubes are often not operational. Therefore, combustion air is drawn through the tubes of least resistance, those which are not in use, and this results in less combustion air being fed to the tubes where the burners are operated and starving them from combustion air thus causing improper combustion and pollution.

SUMMARY OF THE INVENTION

We have found a solution to the above problem by modulating the exhaust fan capacity. Because the viscosity of hotter gas is more than cold gas, the tubes that are operational and therefore hotter, provide more resistance to the flow of gases. Therefore, contrary to conventional methods we have found that by increasing fan capacity when less tubes are operational, there is provided an adequate supply of combustion air regardless of the number of tubes in operation. When increasing numbers of tubes are made operational, based on external signal demand (i.e. thermostat), exhaust fan capacity is reduced by the controller and increased when the number of operational tubes are decreased.

It is a feature of the present invention to provide a compact, highly flexible and efficient, multi-positionable, multi-dimensional and multi-stage gas-fired heat exchanger system which is adaptable to existing forced air ducts, and which substantially overcomes the above-mentioned disadvantages of the prior art.

Another feature of the present invention is to provide a gas-fired heat exchanger system as above-described which is easy to install in existing air ducts regardless of the size of the duct and the angular position thereof.

Another feature of the present invention is to provide a gas-fired heat exchanger system as above described and which can be used to readily replace existing electric heaters which are more costly to operate.

Another feature of the present invention is to provide a gas-fired heat exchanger system as above described and which is constructed in accordance with parameters of existing air ducts and wherein the physical characteristics of the construction can be determined by way of a dedicated computer software.

Another feature of the present invention is to provide a gas-fired heat exchanger system as above described comprising a plurality of gas heaters and wherein the gas heaters can be modulated to adjust the heating capacity from about 5% to 100%.

Another feature of the present invention is to provide a gas-fired heat exchanger system as above described and wherein the main component parts of the system are all accessible on a support panel which is located exteriorly of the convection ducts and easily accessible.

Another feature of the present invention is to provide a gas-fired heat exchanger system as above described and wherein a novel turbulator is used within the heat transfer tubes to increase the efficiency of the heat exchanger.

Another feature of the present invention is to provide a gas-fired heat exchanger system as above described and wherein the flue combustion gases can be evacuated regardless of the position of the heat exchanger and by simple means and wherein the exhaust fan capacity is modulated by control means whereby the exhaust fan capacity is controlled in an inversed proportional manner to the number of gas burners in operation to ensure a constant supply of gas/air mixture in the tubes in operation whereby to obtain optimal combustion and maximum efficiency.

According to another feature of the present invention the control means can be effectuated by controlling the speed of the exhaust fan or by any other means of controlling the air supply capacity to the individual tubes such as inlet or outlet air dampers, etc.

According to the above features, from a broad aspect the present invention provides a compact, highly flexible and efficient, multi-positionable and multi-dimensional gas-fired multi-stage heat exchanger system for use in a forced air duct. The heat exchanger comprises a plurality of heat transfer tubes which are provided in numbers depending on the desired BTU/h capacity needs of the heat exchanger. The tubes are secured to a support means. A plurality of gas burners are provided and each mounted on the support means and disposed for directing a flame at an inlet opening of an associated one of the heat transfer tubes. A gas distribution manifold is provided for supplying gas to the burners. A position orientable modulating gas valve is secured to the manifold and connectable to a gas supply line for controlling the gas pressure to the burners and therefore the intensity of the flame. The gas valve is disposed horizontal regardless of the angular position of the system when secured to a duct. A plurality of solenoid valves is secured to the manifold and to a respective one of the burners whereby to operate the burners independently from one another. The tubes each have an outlet connected to a combustion products collector housing having an exhaust fan to evacuate the combustion products. A system programmed controller means is connected to an external heating demand device for receiving an input signal dependent on an air temperature requirement. The solenoid valves are controlled by the controller means dependent on the input signal to control the operation of the gas burners. The controller means controls exhaust fan capacity in an inversely proportional manner to the number of gas burners in operation to ensure a constant supply of gas/air mixture in the tubes in operation whereby to obtain optimal combustion and maximum efficiency.

BRIEF DESCRIPTION OF THE DRAWINGS

The preferred embodiments of the present invention will now be described with reference to the accompanying drawings in which.

DESCRIPTION OF PREFERRED EMBODIMENTS

Figure 1:
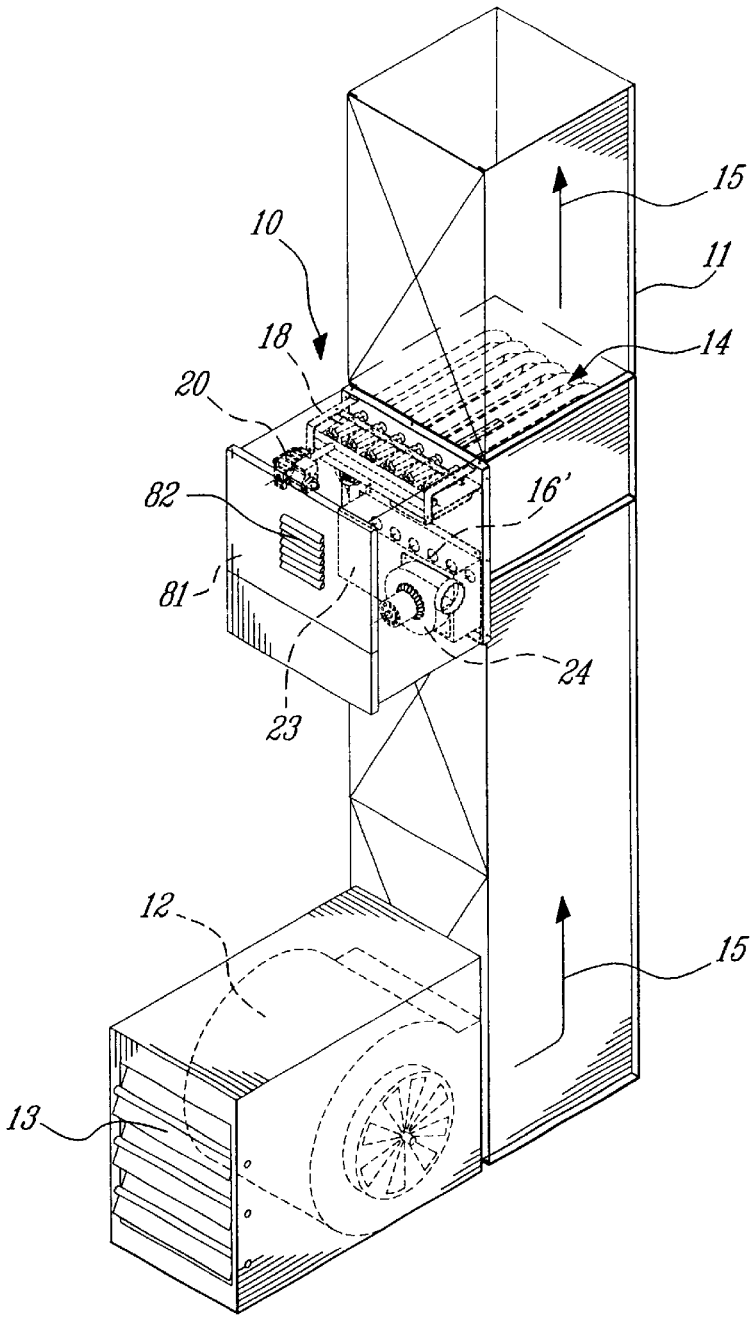
FIG. 1 is a perspective view illustrating a gas-fired heat exchanger system of the present invention mounted in an air duct of a forced air system.

Referring now to FIG. 1 there is shown generally at 10 the compact, highly flexible and efficient, multi-positionable, multi-dimensional and multi-stage gas-fired heat exchanger system of the present invention and as herein mounted in a forced air duct 11. An independent blower 12 circulates air from an air entry duct 13 through the multi-stage heat transfer tubes 14 in the direction of arrow 15.

Figure 2:
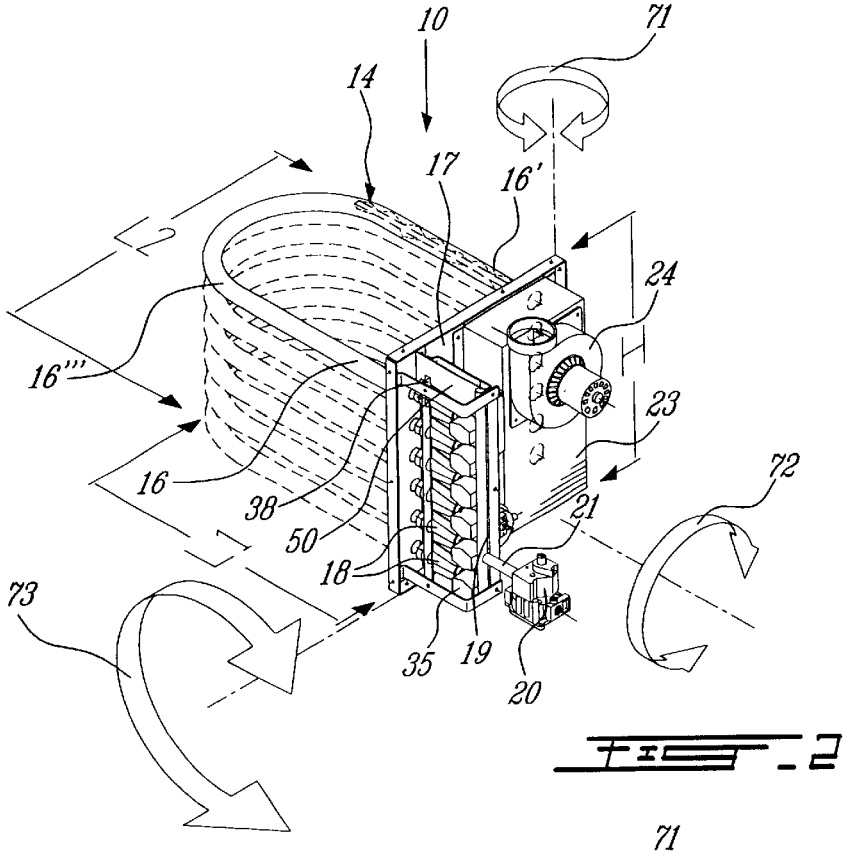
FIG. 2 is a perspective view showing the basic component part of the heat exchanger secured to a support panel and utilizing U-shaped tubes.
Figure 3:
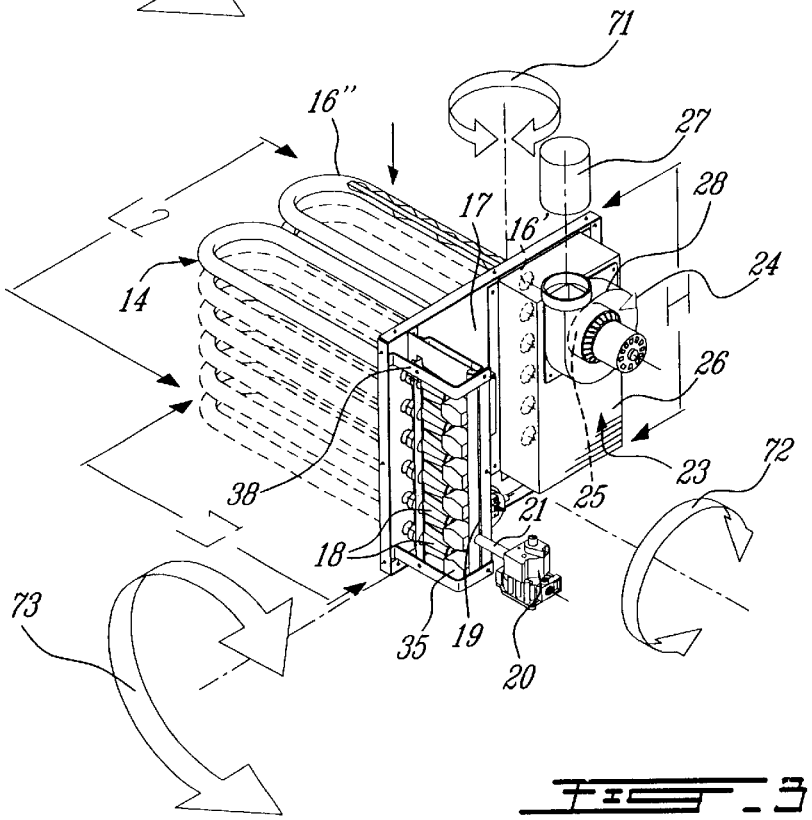
FIG. 3 is a perspective view similar to FIG. 2 but showing W-shaped serpentine tubes.
Figure 4:
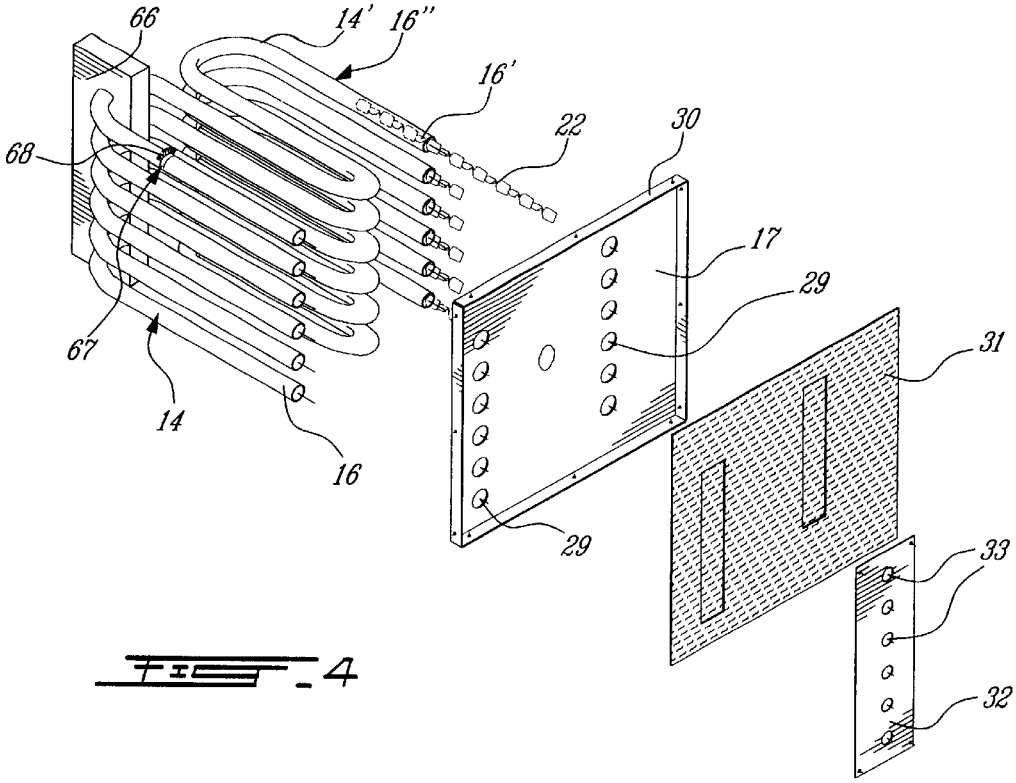
FIG. 4 is an exploded perspective view showing the construction of the support panel and how the tubes are securable thereto.

Referring now to FIGS. 2 to 4 there will be described the basic component parts of the heat exchanger of the present invention. As shown in FIG. 2 the heat transfer tubes 14 are U-shaped tubes and are secured at opposed ends 16 and 16' to a support panel 17. The end 16 of the tubes 14, is the inlet end, and end 16' is the outlet end. A plurality of gas burners 18, herein venturi type burners are positioned in front the inlet end of the tubes 14 and direct a flame in each of the inlet end sections 16 of each tube. The gas burners 18 are secured to a gas distribution manifold 19. A position orientable gas valve 20, which may be a single or two-stage or modulated valve, is secured to the manifold and through its coupling 21 is always positioned horizontally. For example, as shown in FIG. 1 the heat exchanger system 10 is herein shown as being mounted sideways (horizontal) with the gas valve 20 having been positioned in the horizontal plane (90≡ to its position shown in FIG. 3).

As more clearly shown in FIG. 4 gas flow turbulators 22 are disposed in the outlet end sections 16" of the tubes, herein a W-shaped heat transfer tube 14' whereby to induce turbulence in the hot flue-gas flow in each of the tubes to modify the efficiency in heat transfer along the outlet section 16". What the turbulators do is to direct the hot flue-gas along the inner circumferential wall of the tubes and there is virtually no gas flow along the central longitudinal axis of the tubes in the outlet section 16" where the turbulator is positioned. Although not shown a turbulator section could also be positioned in the inlet end section 16'" of the U-shaped tube 14 as shown in FIG. 2 but in an area space behind the flame of the burners, which flame projects into the inlet end section of these tubes. This would also increase the efficiency of the heat transfer tubes.

As shown in FIG. 3 the outlet end 16' of these tubes 14, 14', which are secured to the support panel 17, open in a collection housing 23 which receives combustion gas from the tubes. An exhaust fan 24 is secured to an outlet port 25 formed in an outer wall 26 of the housing 23 to create a suction within the collection housing to draw the hot combustion products through the tubes and to exhaust the combustion products into a chimney duct 27. The speed of the exhaust fan 24 is controlled in a modulated manner, by a system controller as will be described later with reference to FIGS. 18 to 21 to reduce CO and maintain a high combustion efficiency.

The exhaust fan 24 also has an adjustable shroud 28 which permits it to be positioned at various angles depending on the desired orientation of the chimney duct 27. Accordingly, regardless of the position of the heat exchange system when secured in a duct, the exhaust is flexible and permits the evacuation of combustion products along any desired path or angle.

As shown in FIG. 4 the support panel 17 is provided with a plurality of pre-drilled holes 29 to mount to the inlet and outlet sections of the tubes. The panel also has internal flanges 30 to facilitate the connection of the support panel to a front housing as will be described later. It also provides for ease of location of a thermal insulating sheet 31 over the front surface of the panel to protect the panel against the intense heat of the flame of the burners and the combustion products in the collection housing 23. As also shown in FIG. 4 an air/gas turbulator plate 32 is securable over the holes 29 facing the burners.

Figure 8:
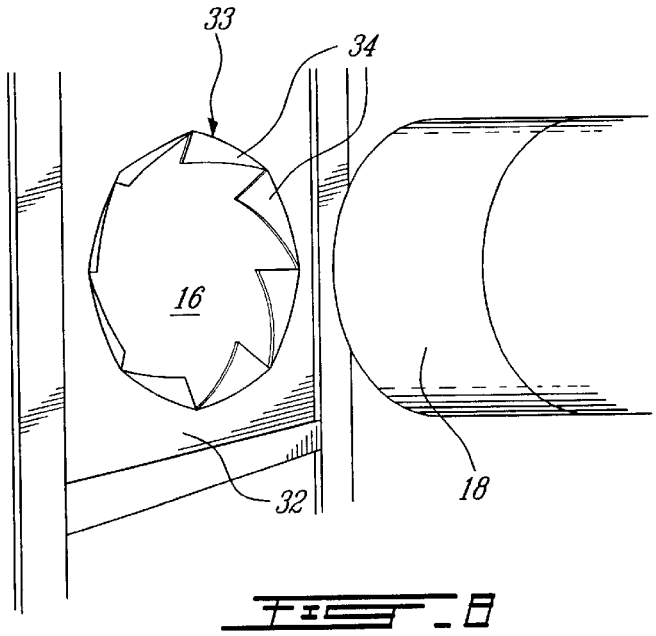
FIG. 8 is an enlarged view showing the construction of the air/gas turbulator plate secured about the inlet of the tubes in proximity of the gas burner whereby to impart added turbulence to the flame.
Figure 9:
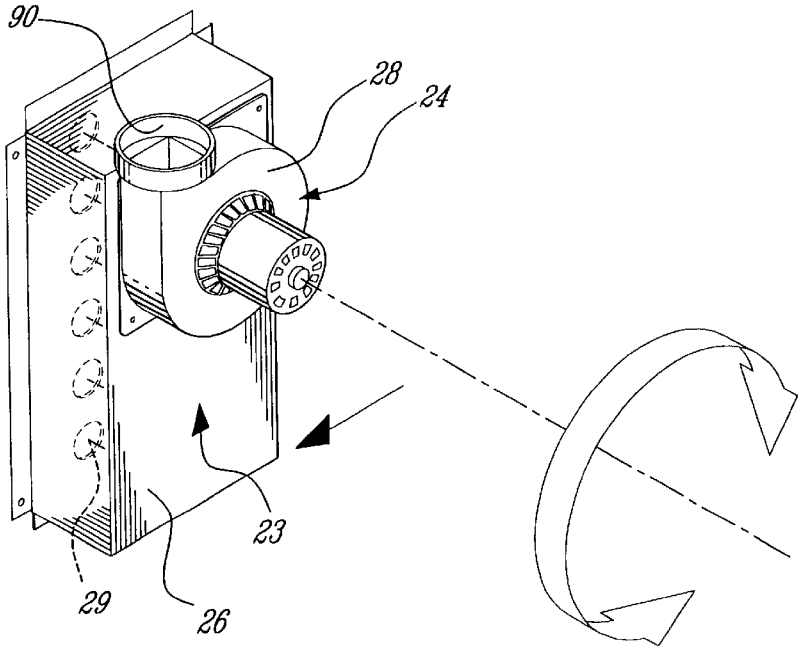
FIG. 9 is a perspective view illustrating the construction of the combustion product collection housing and adjustable exhaust fan.

With added reference to FIG. 8 it can be seen that the turbulator plate 32 is provided with an orifice 33 having inwardly extending deflector flanges 34 disposed side by side all about the circumference of the orifice whereby to increase turbulence at the inlet end opening 16 of the tubes where the flame is injected. These deflector flanges 34 diminish the laminar secondary air flow and maximizes thermal exchange with the tubes in the inlet end sections thereof.

Figure 5:
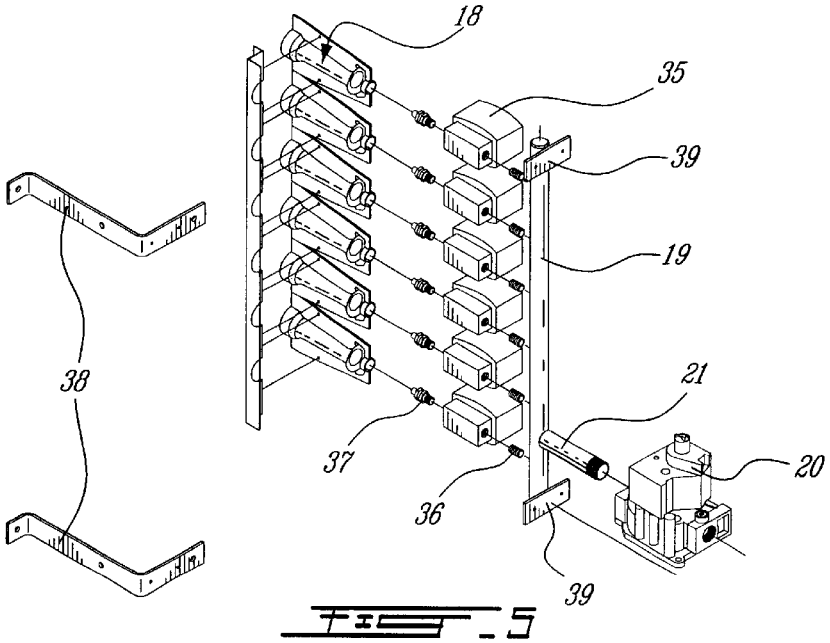
FIG. 5 is an exploded perspective view showing the construction and associated attachments of the gas burners.
Figure 6:
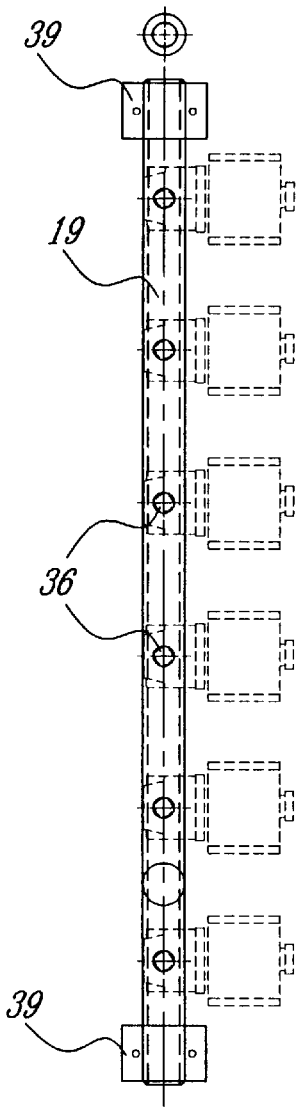
FIG. 6 is a front view of the gas distribution manifold and solenoid valves.
Figure 7:
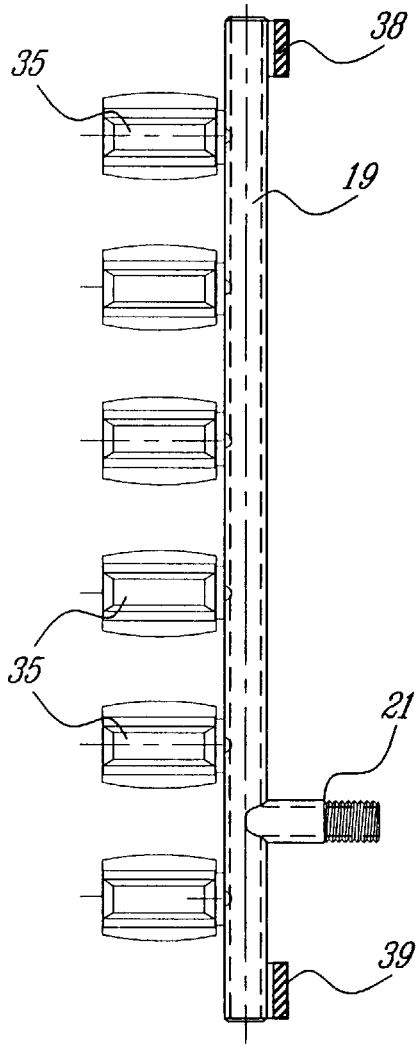
FIG. 7 is a side view of FIG. 6.

With reference now to FIGS. 5 and 6 there is shown in greater detail the construction and mounting of the burner assemblies. As previously described the burners 18 are venturi type burners and they have a nominal heat rate, such as, 17.5K BTU/h, 23.5K BTU/h, 30K BTU/h and 50K BTU/h. A solenoid valve 35 is also associated with each of the burners 18. These valves 35 are used to operate the burners 18 independently by controlling the solenoids whereby to control the heating capacity of the system from about 5% to 100% of its total thermal heat exchange capacity. These solenoids have a very quick response time and are connected to the gas distribution manifold 19 by threaded conduits 36 permitting quick assembly and disassembly of the burner units for assembly, replacement or repair. Nozzles 37 are also separately mounted between the solenoid and the burners 18 and provide ease of assembly and maintenance. The entire assembly is supported on the support panel 17 by brackets 38. Accordingly, this assembly can be pre-assembled and then secured to the support panel. 17. The brackets 38 are secured to flanges 39 welded to opposed ends of the manifold 19.

Figure 10:
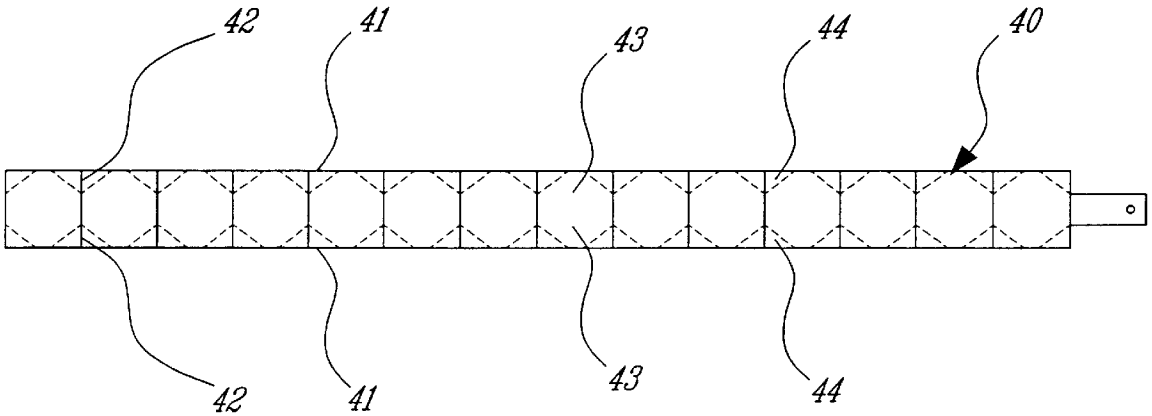
FIG. 10 is a side view of an elongated rectangular metal plate utilized to construct the flue-gas turbulator.
Figure 11:
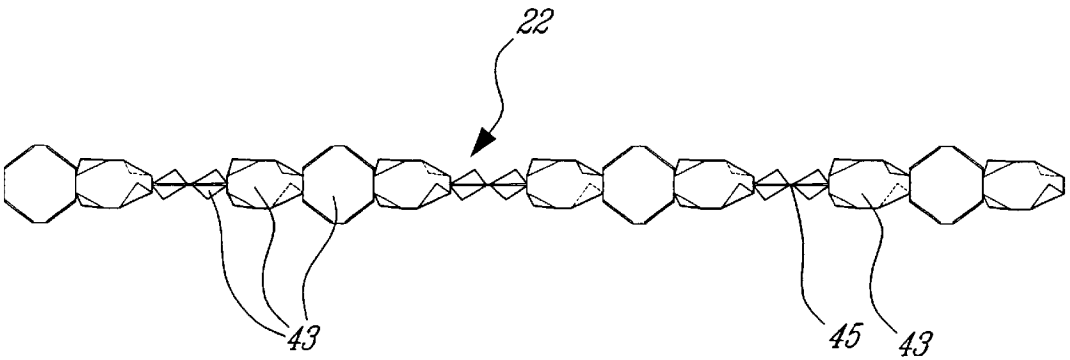
FIG. 11 is a side view showing the construction of the turbulator sections.
Figure 12:
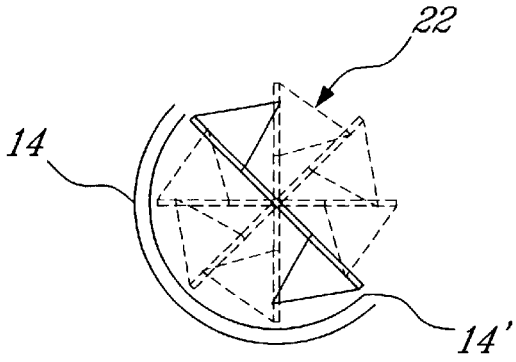
FIG. 12 is an end view of FIG. 11 showing the disposition of the sections.

With reference now to FIGS. 10 to 12 there will be described the construction of the turbulator 22. As shown in FIG. 10 the turbulator is constructed of an elongated rectangular flat metal plate 40 which is cut from opposed elongated edges 41 thereof to form opposed slits 42 whereby to form a plurality of deflection sections 43. The deflection sections 43 are octagonally shaped as shown in FIG. 11 by bending the corner sections 44 in opposed directions whereby to form deflection plate sections 43 of octagonal contour. These deflection plate sections 43 are also bent in the plane of the strip of the flat plate 40 at angles of approximately 45, as shown in FIG. 12 to form a twisted turbulator to force the combustion gas flow flowing therethrough away from the center of the tubes 14 to an inner surface 14' of the tubes, as illustrated in FIG. 12. The strip can also be cut at any desired length and preferably between the deflection plate sections 43, at areas such as illustrated by reference numeral 45, to fit in a desired section of a tube. Accordingly, the turbulator can have different quantities of deflection plate sections. Although not shown, the sections 44 could be of different sizes to create turbulation.

Figure 13:
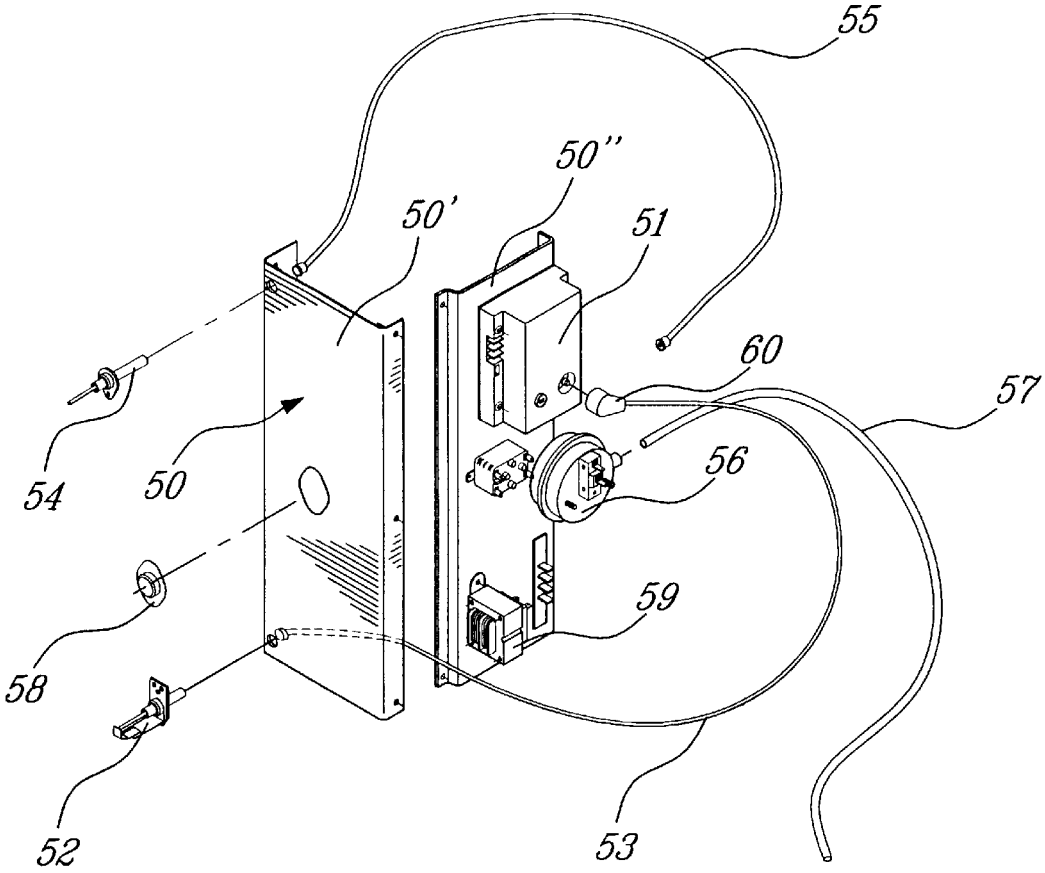
FIG. 13 is an exploded perspective view illustrating the mounting plate for mounting associated hardware with the equipment mounted on the support panel.

As shown in FIG. 13 various components associated with the system are also mounted on a component mounting plate 50 forwardly of the support panel 17. The mounting plate 50 extends outwardly on a vertical axis spaced from the burners 18 as can be seen in FIG. 2. The mounting plate assembly 50 is provided to mount associated hardware and to make it readily accessible for servicing and repair. As hereinshown an igniting control device 51 is secured to the component mounting plate assembly and the igniter 52 is secured to the side plate 50' at a position to ignite the burners. An igniter cable 53 connects the igniter 52 to the igniter controller 51. A flame detector 54 is also mounted on the side plate 50' and has a detector cable 55 connected thereto, as is well known in the art. A pressure detector 56 is also secured to the horizontal panel 50" and a detector tube 57 is connected thereto. A high limit temperature detector 58 is also connected to the panel 50'. A voltage transformer 59 and a relay 60 are also connected to the horizontal panel for ready access and servicing.

Figure 17:
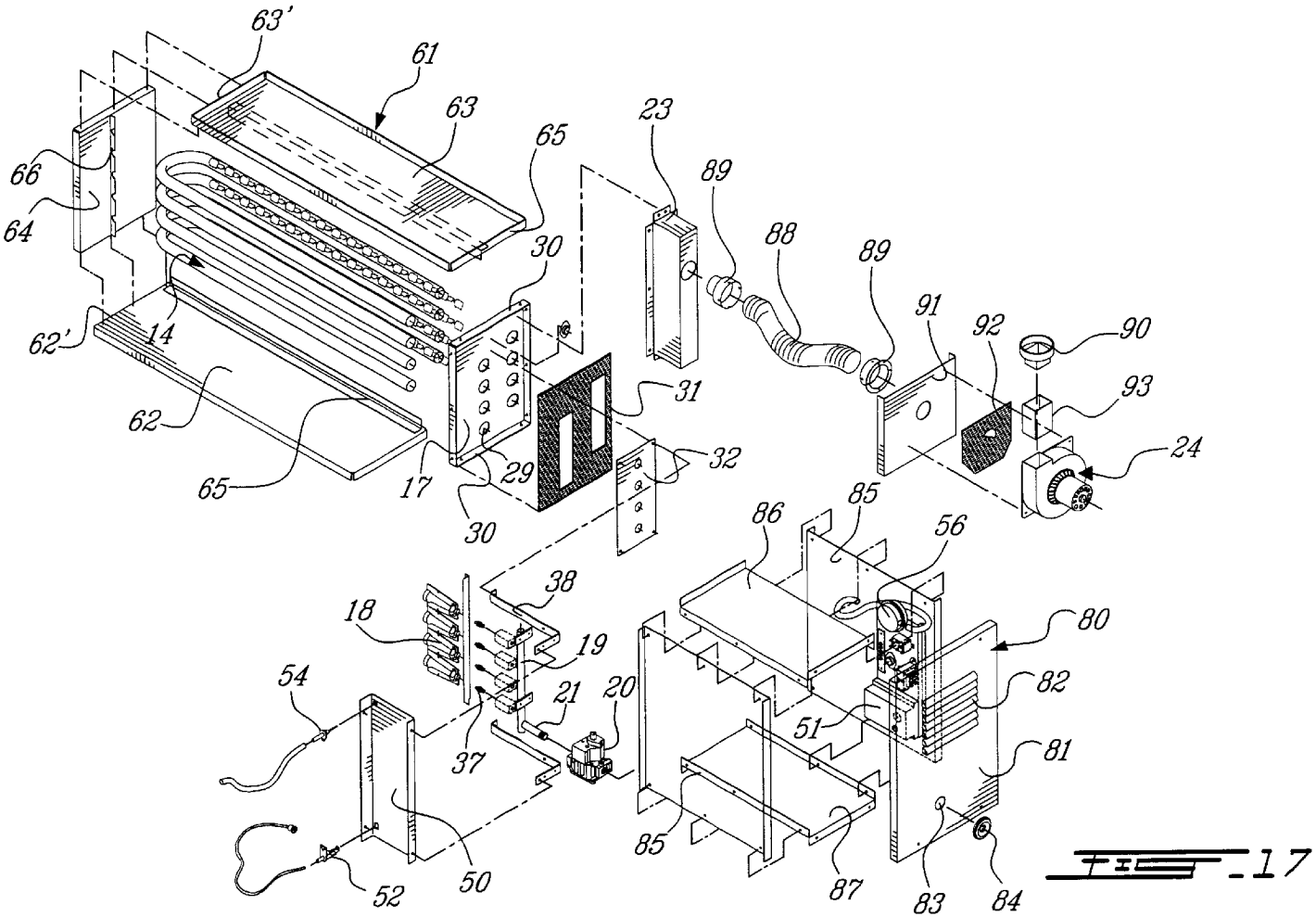
FIG. 17 is an exploded view of the entire heat exchange system with its front housing and herein utilizing U-shaped heat transfer tubes;.

With reference to FIG. 17 there is shown the construction of a support frame 61 which is secured to the support panel 17. The support frame 61 comprises a bottom and top wall 62 and 63 respectively secured to the top and bottom internal flanges 30 of the front panel 17, and a rear wall 64 secured between rear edges 62' and 63' of the bottom and top plates 62 and 63, respectively. The top and bottom and rear walls all have contour flanges which help to secure same in an air duct such as the duct 11 as shown in FIG. 1, to orient the tubes for heat exchange with air flow in the duct when a blower pushes air through the duct for heating the convected air. The dimensions of the plate are dictated by the cross-sectional dimension of the duct in which the system is to be installed.

As also shown in FIG. 17 the top and bottom walls 63 and 62 are provided with air deflecting flanges 65 which project internally in the air flow to cause air turbulence of the convected air in the area of the transfer tubes to improve heat transfer between the tubes and convected air. As also hereinshown the rear wall 64 is provided with a vertical tube support flange 66 to support a far end section of the heat transfer tubes to maintain them in spaced parallel stack relationship. This flange is also illustrated in FIG. 4 and as shown in that Figure heat exchange clamps 67 may also be secured to the tubes 14. The heat exchange clamps are provided with a plurality of projecting flanges 68 to dissipate heat into the air flowing through the heat exchanger tubes. Preferably the heat exchange clamps are secured to at least some of the tubes along the inlet section thereof where the tubes are at a higher temperature. As previously described these tubes may be of U-Shapes, W-shapes, square shapes or any other suitable shapes for heat exchange with the convected air in the duct and to suit the application.

As previously pointed out, the gas-fired heat exchanger system of the present invention is customizable to suit air ducts of different sizes and different capacity requirements. To this end there has been developed a computer software to calculate specific physical parameters for the construction of the heat exchanger of the present invention. The computer is inputted information relating to the dimension of duct where the heat exchanger is required to be installed as well as information relating to the volume of air to be heated. Parameters of the static pressure of the forced air system are also inputted in the computer as well as the temperature of air to be convected upstream of the heat exchanger. Also inputted is the desired temperature required downstream of the heat exchanger. This inputted information is analyzed and the software produces physical parameters for the design of the unit including the configuration of the heat transfer tubes, the quantity of the tubes required, the diameter and length of the tubes and the thermal capacity of the burners. Accordingly, the size of the unit is adjustable whereby the length of its side L1, width L2, and height H, as shown in FIG. 2, are variable.

As shown in FIGS. 1 to 4 and 17 the heat transfer tubes 14 are all connected in stack parallel spaced relationship and all attached to the support panel to produce a compact package. In most instances the heat exchanger will comprise a plurality of heat exchange tubes and these can be controlled in a "multi-stage" application as shown by the schematic electrical diagram in FIG. 15 or in a "modulated mode" as illustrated by the schematic diagram of FIG. 16. In the "multi-stage" application the thermal capacity of the heat exchanger can be controlled by switching on and off some of the burners thereby utilizing only certain ones of the heat transfer tubes to satisfy the heat demand. In the "multi-stage" mode the gas valve 20 could be a two-stage valve which permits a control of the temperature in a range of from about 5% to 100% of its total capacity. In that mode, with the two-stage valve 20 the first burner is ignited at 50% of its maximum capacity and later its capacity is increased to 100%. The other burners are then ignited one after the other and this is how the temperature control of the heat exchanger is varied.

In the "modulated mode" all of the burners function at the same time, the modulation is obtained by the principal valve 20 which is a modulated type valve. With this valve the gas pressure to all of the burners is modulated in accordance with the heat requirement. In this mode the modulation of the maximum heat produced by the heat exchanger can be varied between approximately 40% to 100% of the maximum capacity of the heat exchanger.

Figure 14:
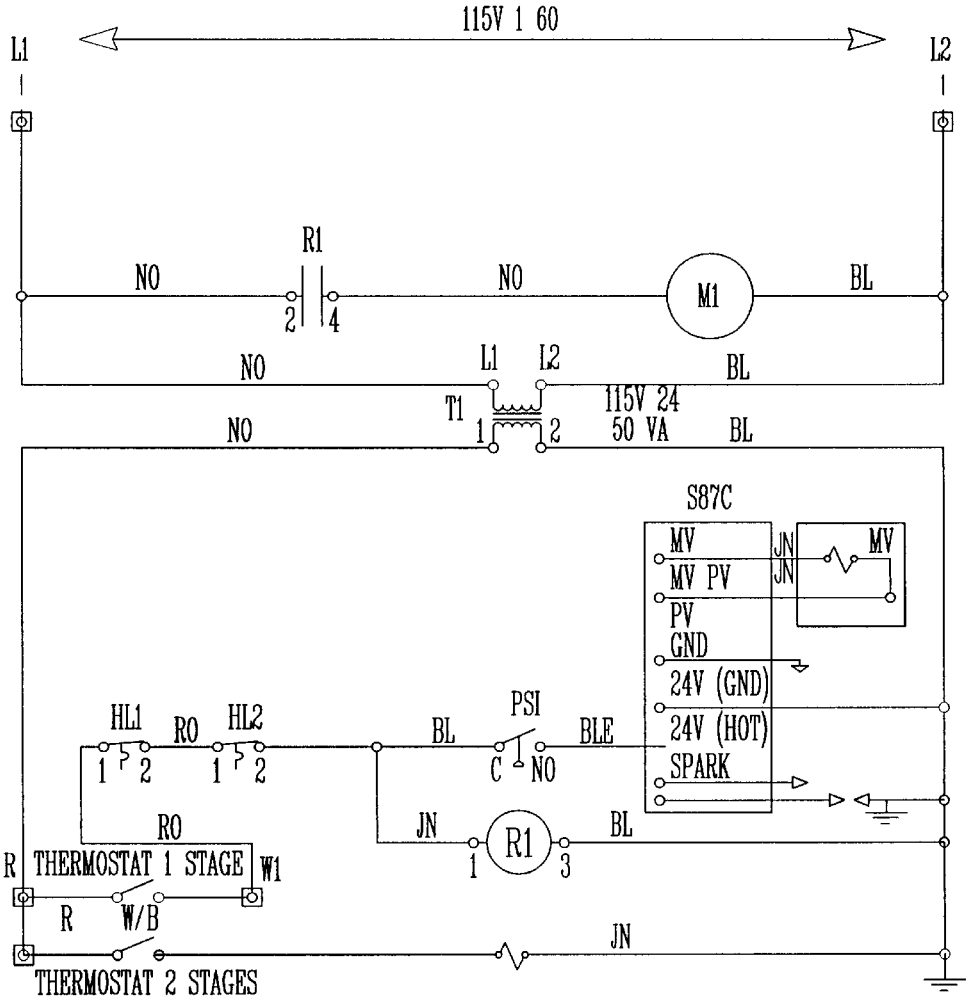
FIG. 14 is an electrical diagram illustrating the electric circuit utilized for a single stage heat exchanger.

FIG. 14 is a circuit diagram for a single stage heat exchanger capable of generating a predetermined heat capacity which is non-variable.

As illustrated in FIGS. 2 and 3 the heat exchange system 10 may be mounted at any desired position along the X, Y or Z axis as illustrated by arrows 71, 72 and 73. Regardless of the positioning of the unit the gas valve 20 is adjusted to lie in a horizontal plane. This is done by using a suitable coupling 21 or simply rotating the gas valve on the threaded end of the pipe coupling 21 depending on the position of the unit. But this is predetermined by the application.

As also shown in FIG. 17 a protective housing 80 having an access panel 81 for access to the support panel 17 may also be provided. For security a lock could also secure the front panel 81 to the housing. As hereinshown the front panel 81 is provided with an air intake 82 to admit combustion air to the burners. A gas line entry port 83 may be provided on the front panel around the side and as hereinshown is protected by a grommet 84. The exhaust fan 24 may also be secured to either the side walls 85 or top and bottom walls 86 and 87 of the housing depending on the position of the installation and the flue pipe. Accordingly, there is provided a flexible extension tube 88 having couplings 89 at opposed ends thereof to connect the collection housing 23 to the exhaust fan 24. The exhaust fan 24 is also provided with a coupling 90 to secure to an exhaust pipe and attaching flange and gaskets 91 and 92 respectively. An extension pipe 93 may also be secured to the exhaust fan, if necessary.

Figure 15:
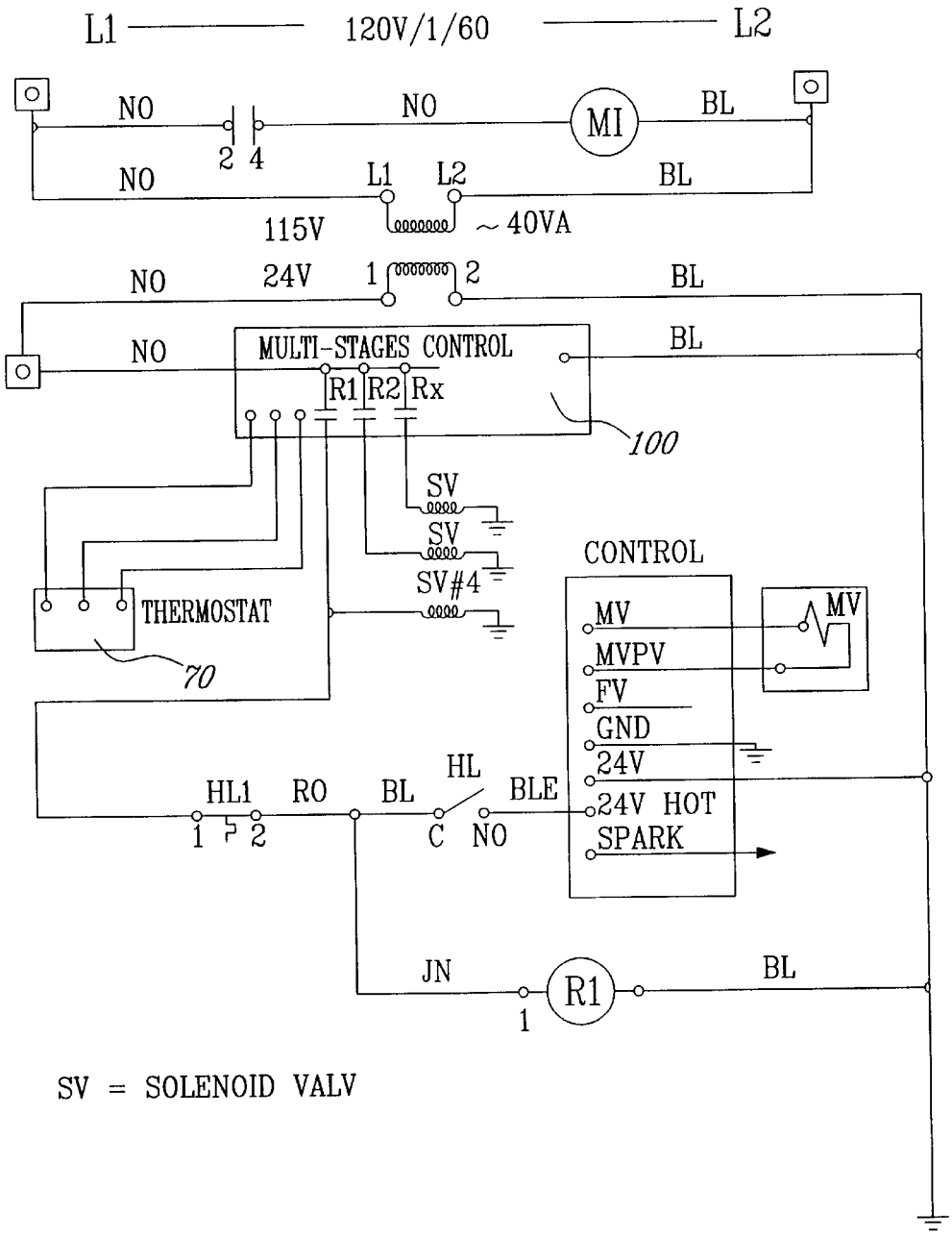
FIG. 15 is an electrical diagram showing the electric circuit for a multi-stage system.
Figure 16:
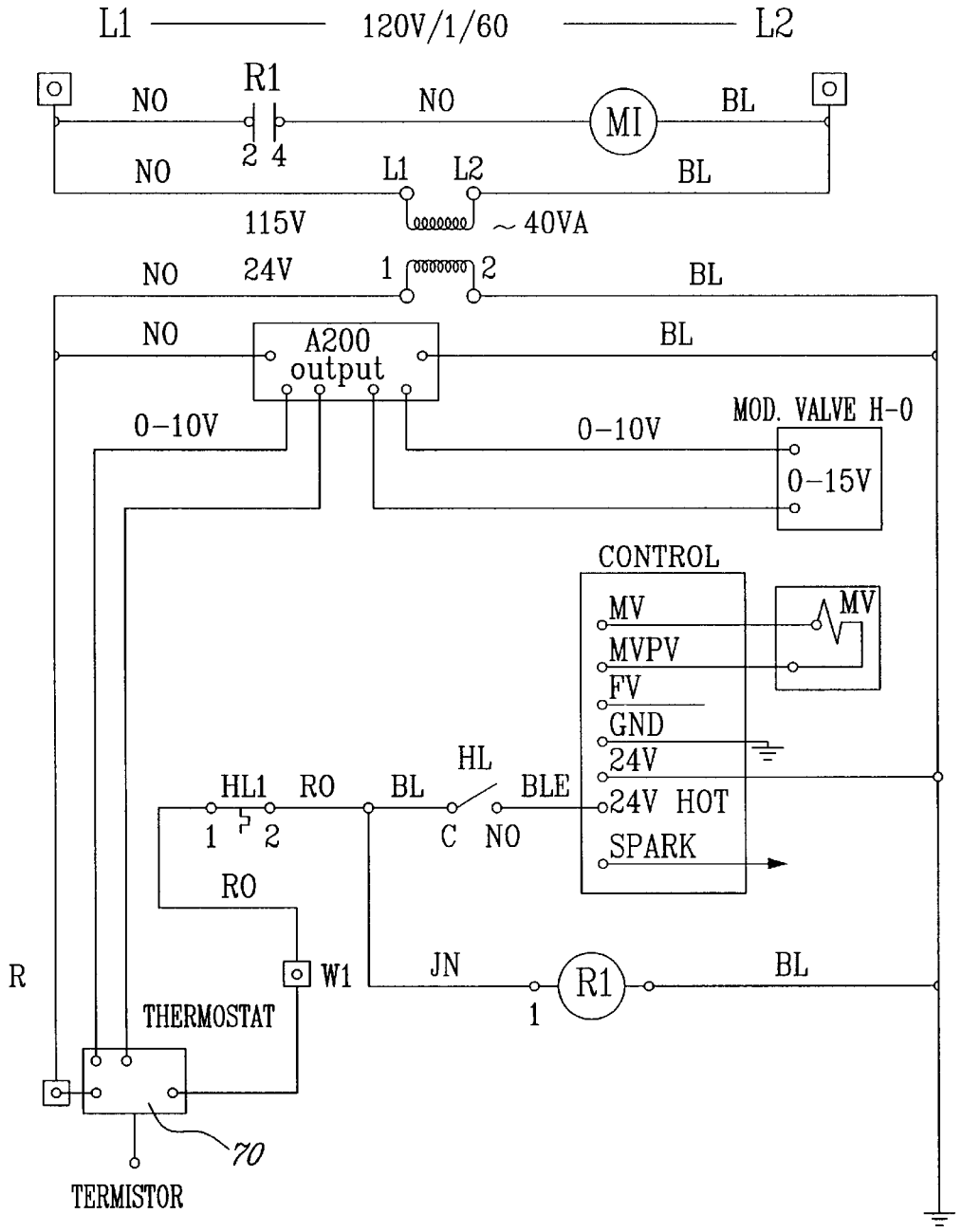
FIG. 16 is an electrical diagram illustrating the electric circuit for a modulated system.

Although the electric circuit diagrams of FIGS. 14 to 16 have not been described in detail it is only necessary to describe that in the single stage application the heat exchanger also operates in a single maximal heat generating mode when the valve 20 is "on" to supply gas to the burners.

In operation, the system is actuated by a heat requirement on the low voltage created by the thermostat and the system firstly monitors the safety equipment associated therewith. The relay 60 then connects the gas, herein natural gas, and upon detecting the gas pressure, the ignition control commands the opening of the gas valve and the igniter. As soon as the flame is detected by the flame detector 54 the apparatus is in operation. Once the thermostat sends the signal that the temperature has reached its setting, the gas supply to the valve 20 is cut and the burners extinguished.

In the modulating mode as illustrated by FIG. 16 the pressure of the gas is modulated through a gas modulating valve. In this particular application there is provided a stack of heat transfer tubes. The gas modulating valve can vary the temperature of the flame and therefore heat exchanger between 40% and 100% of its maximum value. The purpose of the burner modulation is to maintain the temperature of the air to be heated substantially constant. The gas modulating valve is controlled by a variable control device 100 as shown in FIG. 15. The control circuit is illustrated by FIG. 14.

With reference to FIG. 15 there is shown the multi-stage operation wherein each of the burners 18 is controlled independently by the solenoid valves 35. The burners are ignited, or not, one at a time to satisfy the temperature demands. If the main gas valve is a two-stage valve the first burner can be positioned to generate a low temperature flame which is usually half of the maximal intensity or at a high temperature flame. By controlling the temperature of the flame and the number of burners that are activated it is possible to control the temperature of the heat exchanger within the range of about 5% to 100%, as previously described. This way it is possible to provide a more precise control of the air temperature for comfort. In addition the speed of the exhaust fan 24 can be controlled in combination with the burners by suitable control circuitry.

Figure 18:
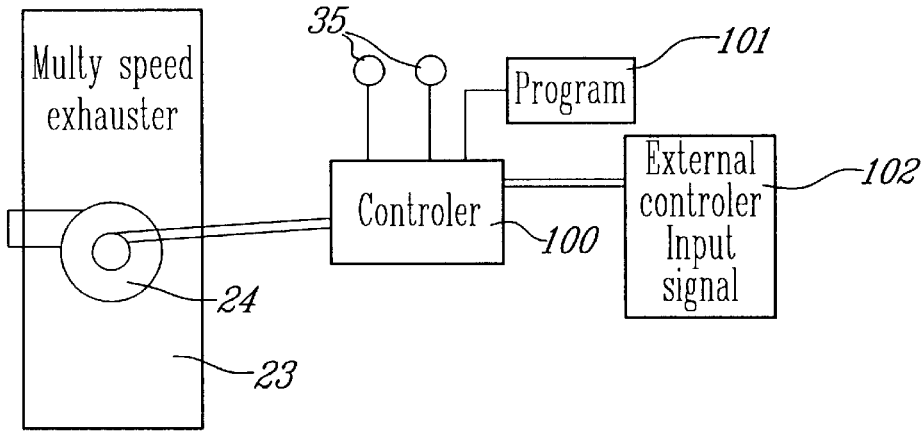
FIG. 18 is a simplified schematic diagram of the system program controller herein utilized to control the speed of the exhaust fan.
Figure 19:
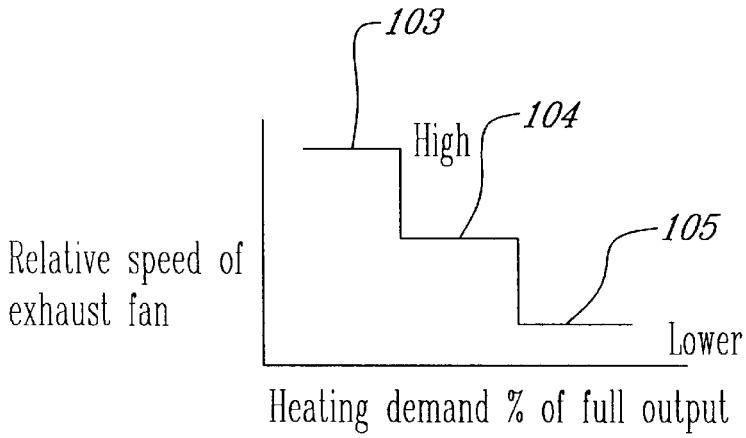
FIG. 19 is a graph showing a stepped controlled application of the exhaust fan speed relative to the percentage of heating demand of full output.

As previously described in order to obtain maximum efficiency of the operation of a multi-stage multi burner heating system and to reduce CO emission, it is important to control the air supply in relation to the number of burners that are in operation whereby a proper gas/air mixture is supplied to each burner in operation. As previously described because of viscosity of hotter gas is more than cold gas the tubes that are operational are hotter and provide more resistance to the flow of gases. Therefore, contrary to conventional methods we have found that by increasing fan capacity when less tubes are operational there is provided an adequate supply of combustion air and when more burners are operational the air supply or fan capacity needs to be reduced. As shown in FIGS. 18 and 19 this can be achieved by a system program controller means 100 which is made operational by a program 101 depending on the specific application of the system. This would include such parameters as the number of burners in the system, the type of exhaust fan and the type of input demand signals generated by an external temperature sensor and control device 102 which could be a thermostat for example.

As shown in FIG. 18 the system program controller is a stepped multi-speed exhaust fan controller to control the speed of the exhaust fan 24. This controller controls the supply of voltage to the fan whereby to vary its speed in a step fashion as illustrated in FIG. 19. As shown in FIG. 19 the fan is at its maximum speed during its high voltage supply period 103 and wherein there are few of the burners in operations whereby to ensure an adequate supply of combustible gas/air mixture fed to the burners that are in operation as the air has a tendency to flow through the tubes which are cooler and therefore not in operation, as previously described. As the output supply of the system increases, this is sensed by the remote thermostat 102 which sends signal to the controller and the fan speed will be stepped down to the next step 104 where its voltage supply diminishes and finally to its last step 105 when more burners are in operation thereby requiring a decrease in fan capacity.

Figure 20:
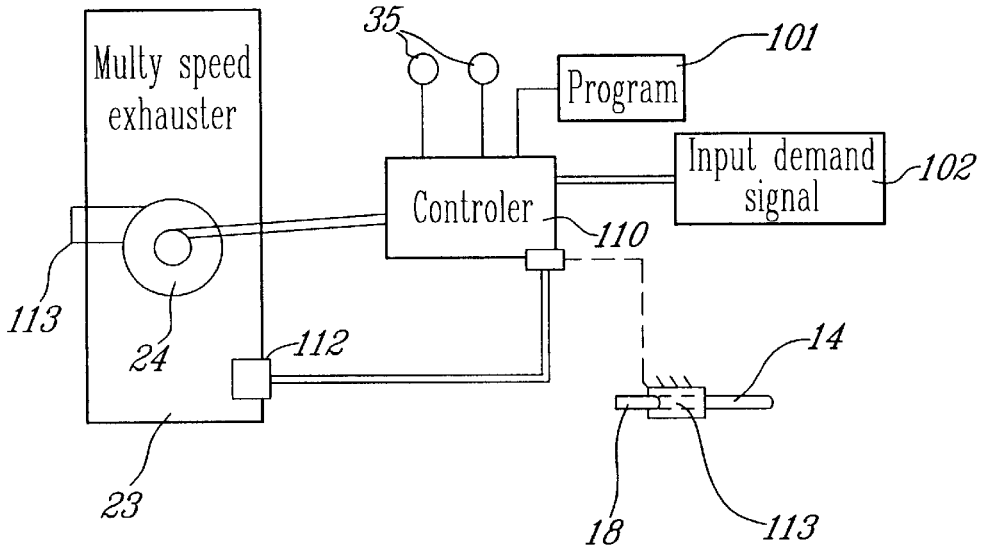
FIG. 20 is a schematic diagram similar to FIG. 18 but showing additional applications of the controller whereby it controls mechanical means to admit air in the exhaust fan collector housing or to control the air supply to individual tubes where the burner is operational.
Figure 21:
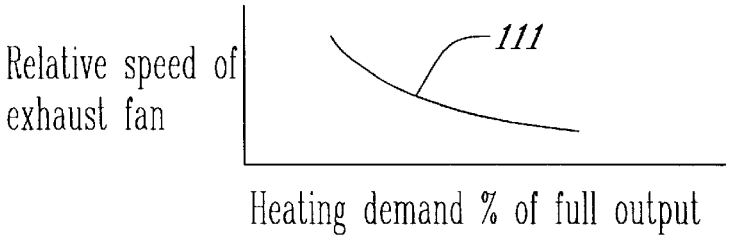
FIG. 21 is a graph showing a constant control application of the speed of the exhaust fan relative to heating demand percentage of full output.

With reference now to FIGS. 20 and 21 it can be seen from FIG. 21 that the exhaust fan controller 110 is a variable speed controller to control the speed of the exhaust fan 24. Accordingly, the speed of the exhaust fan is continuously decreased as the heating supply or the number of burners are ignited to provide the full output demanded by the remote thermostat 102. The curve 111 illustrates this constant control and it can be seen that as the output supply increases the fan speed decreases.

Referring again to FIG. 20 it can be seen that the system program controller can also control air pressure in the exhaust gas collector housing 23 by controlling a mechanical damper 112 which can be connected to the collector housing 23. It is also conceivable that dampers could be connected to the outlet 113 of the exhaust fan. These dampers would be controlled automatically depending on the program 101 associated with the controller 110 to control the pressure in the housing whereby to maintain a constant supply of gas/air mixture in the tubes in operation. It is further conceivable, as shown in FIG. 20 that the controller 110 could control a variable air damper 113 secured to the inlet of the burner tubes 14 to supply adequate air mixture to the burners 18. However, the preferred embodiment is to control the speed of the exhaust fan in either a step or continuous fashion as illustrated in FIGS. 18-21 whereby to achieve adequate supply of air to the gas burners to maintain optimal combustion and maximum efficiency during the operation of the heat exchanger system.

It is within the ambit of the present invention to cover any obvious modifications of the preferred embodiment described herein, provided such modifications fall within the scope of the appended claims.

What is claimed is:

1. A compact, highly flexible and efficient, multi-positionable and multi-dimensional gas-fired multi-stage heat exchanger system for use in a forced air duct, said heat exchanger comprising a plurality of heat transfer tubes, said tubes being provided in numbers depending on the desired BTU/h capacity needs of said heat exchanger, said tubes being secured to a support means, a plurality of gas burners, each gas burner mounted on said support means and disposed for directing a flame at an inlet opening of an associated one of said heat transfer tubes, a gas distribution manifold for supplying gas to said burners, a position orientable modulating gas valve secured to said manifold and connectable to a gas supply line for controlling the gas pressure to said burners and therefore the intensity of the flame, said gas valve being disposed horizontal regardless of the angular position of said system when secured to a duct, a plurality of solenoid valves secured to said manifold and to a respective one of said burners whereby to operate said burners independently from one another, said tubes each having an outlet connected to combustion products collector housing having an exhaust fan to evacuate said combustion products and a system programmed controller means connected to an external heating demand device for receiving an input signal therefrom dependent on an air temperature requirement, said solenoid valves being controlled by said controller means dependent on said input signal, to control the operation of said gas burners, said controller means controlling the fan capacity in an inversely proportional manner to the number of said gas burners in operation to ensure a constant supply of gas/air mixture in said tubes in operation whereby to obtain optimal combustion and maximum efficiency.

2. A heat exchanger as claimed in claim 1 wherein said system programmed controller means is a multi-speed exhaust fan controller means to control the capacity of said exhaust fan.

3. A heat exchanger as claimed in claim 2 wherein said multi-speed exhaust fan controller means is a staged speed controller to control the speed of said exhaust fan in speed stages in an inversely proportional manner dependent on the number of gas burners in operation to achieve maximum combustion efficiency depending on the number of gas burners in operation to obtain required output demand of said input signal from said external heating demand device.

4. A heat exchanger as claimed in claim 1 wherein said multi-speed exhaust fan controller means is an exhaust fan variable speed controller to control the speed of said exhaust fan in said inversely proportional manner dependent on the number of gas burners in operation to achieve maximum combustion efficiency depending on the number of gas burners in operation to obtain required output demand of said input signal from said external heating demand device.

5. A heat exchanger as claimed in claim 1 wherein said system programmed controller means controls the operation of a variable air control damper secured to said exhaust fan inlet or outlet to reduce the exhaust capacity in an inversely proportional manner to achieve maximum combustion efficiency depending on the number of gas burners in operation to obtain required output demand of said input signal from said external heating demand device.

6. A heat exchanger as claimed in claim 1 wherein said system programmed controller means controls the operation of a variable air control damper secured to each said tubes to control and maintain a constant supply of gas/air mixture in said tubes that are in operation.

7. A heat exchanger system as claimed in claim 1 wherein there is further provided gas flow turbulence inducing means associated with at least some of said tubes to cause turbulence in a hot combustion flue-gas flow in each said tubes to modify the efficiency in heat transfer along one or more sections of said tubes by directing hot combination flue-gas along an inner circumferential wall of said tubes.

8. A heat exchanger as claimed in claim 7 wherein said support means is a support panel provided with attachment means to secure same in a hole formed in a ventilation duct regardless of the angle of disposition of said duct.

9. A heat exchanger as claimed in claim 7 wherein said gas flow turbulence inducing means is comprised by an elongated rectangular flat plate having a plurality of deflection sections, said deflection sections having corner angled sections extending to opposed sides of said flat plate to form deflection sections of octagonal contour, said deflection sections being disposed at an angle with respect to one another to form a twisted turbulator to force said combustion gas flow away from the center of said tubes to an inner surface thereof.

10. A heat exchanger system as claimed in claim 9 wherein said twisted turbulator is positioned in an outlet section of said tubes.

11. A heat exchanger system as claimed in claim 9 wherein said deflection sections are of different sizes along elongated sections of said plate, said twisted turbulator being severable into a desired length.

12. A heat exchanger system as claimed in claim 9 wherein said deflection sections are disposed at predetermined equidistantly spaced angles with respect to a longitudinal central axis of said turbulator whereby these sections extend all about said central axis, larger ones of said deflection sections having a transverse maximum length for frictional engagement with said inner surface of said tubes.

13. A heat exchanger system as claimed in claim 11 wherein said tubes are U-shaped tubes, therebeing disposed a further twisted turbulator in a forward section of said tubes spaced from said inlet opening of said tubes in an area where there is no flame when the associated burner is operative.

14. A heat exchanger system as claimed in claim 1 wherein there is further provided an air/gas turbular plate having one or more orifices each said orifices being dimensioned to fit about a respective one of said inlet opening of said one or more tubes, each said one or more orifices having inwardly extending deflector flanges disposed side-by-side thereabout to increase turbulence at said inlet openings where said flame is injected to diminish the laminar, secondary air flow and to maximize thermal exchange with said tubes.

15. A heat exchanger system as claimed in claim 1 wherein said exhaust fan has an adjustable shroud with an exhaust whereby said exhaust port can be oriented at a desired angle for connection to a flue regardless of the angular position of said support panel and consequently said collection housing.

16. A heat exchanger system as claimed in claim 1 wherein said plurality of heat transfer tubes are dimensioned in accordance with a desired diameter, length, and shape dependent on a desired heat generating capacity and the dimension of a space in said duct where said heat exchanger is to be secured.

17. A heat exchanger system as claimed in claim 1, wherein said burners are venturi type burners have a nominal heat rate of 17.5K BTU/h, 23.5K BTU/h, 30K BTU/h and 50K BTU/h.

18. A heat exchanger system as claimed in claim 1, wherein said heat transfer tubes are connected in a stack, each tube having said inlet and outlet end thereof secured to a support panel constituting said support means whereby said tubes extend in a horizontal plane and parallel to one another with respect to said support panel, a burner support bracket to support said burners in alignment and spaced a predetermined distance from said inlet end of each said tubes, said inlet ends being aligned with one another along a vertical axis of said support panel, said gas distribution manifold being comprised of a vertical pipe to which said solenoid valves are connected, said support panel being accessible exteriorly of said air duct.

19. A heat exchanger system as claimed in claim 18, wherein a thermal insulating sheet is secured to an outer surface of said support panel to protect said panel from hot flames of said burners.

20. A heat exchanger system as claimed in claim 18, wherein said heat exchanger is secured in a support frame comprising a bottom and top wall secured to a bottom and top edge of said support panel, and a rear wall secured between rear edges of said top and bottom walls; said rear wall, top and bottom walls having predetermined dimensions and flange means to secure same in said air duct to orient said tubes for heat exchange with air flow in said duct when a blower pushes air through said duct for heating convected air.

21. A heat exchanger system as claimed in claim 20, wherein said top and bottom walls are provided with air deflecting flanges projecting in said air flow to cause air turbulence in said convected area of said heat transfer tubes to improve heat transfer between said tubes and said convected air.

22. A heat exchanger system as claimed in claim 20, wherein said rear wall is provided with a vertical tube support flange to support a far end section of said heat transfer tubes to maintain them in spaced parallel relationship.

23. A heat exchanger system as claimed in claim 18, wherein there is further provided heat exchange clamps having a plurality of projecting flanges, said heat exchange clamps being secured to at least some of said tubes along an inlet section thereof where said tubes are at a higher temperature for additional heat exchange with convected air displaced in said duct.

24. A heat exchanger system as claimed in claim 1, wherein said heat transfer tubes are one of U-shape, W-shape, square-shape, or other suitable shapes for heat exchange with convected air displaced in said duct.

25. A heat exchanger system as claimed in claim 12, wherein said position orientable gas valves can be disposed at any angle from 0 to 360 degree, and may be a single stage, dual stage, modulating with solenoid or a combination of single stage or dual stage with a plurality of solenoid valves at each burner.

26. A heat exchanger system as claimed in claim 2, wherein said exhaust fan controller means has a program to operate at specific exhaust fan capacity dependent on the number of said gas burners in operation in an inversely proportional manner or control a pressure device disposed at an inlet or outlet of fired ones of said tubes or in said combustion product collector housing to maintain a constant pressure at these locations to assure proper air/gas mixture in said fired ones of said tubes to provide maximum combustion efficiency and reducing CO emissions.

27. A heat exchanger system as claimed in claim 18, wherein each solenoid valve can be operated independently from one another and is supplied with a high or low gas pressure depending on heat demand rate, said supply pressure can be changed by a dual stage gas valve, changing each burner heat output from 100% to 60% of nominal firing capacity, permitting the control of the temperature of said heat exchange in the range of from about 5% to 100% of the maximum thermal heat exchange capacity of said heat exchanger.

* * * * *